US011326341B2

(12) United States Patent
Lutz

(10) Patent No.: US 11,326,341 B2
(45) Date of Patent: May 10, 2022

(54) EXTERIOR INSULATED FINISH WALL ASSEMBLY

(71) Applicant: THE LUTZ COMPANY, Brooklyn Park, MN (US)

(72) Inventor: Timothy Dennis Lutz, Minneapolis, MN (US)

(73) Assignee: TREMCO INCORPORATED, Beachwood, OH (US)

( * ) Notice: Subject to any disclaimer, the term of this patent is extended or adjusted under 35 U.S.C. 154(b) by 0 days.

(21) Appl. No.: 16/983,684

(22) Filed: Aug. 3, 2020

(65) Prior Publication Data

US 2020/0362552 A1 Nov. 19, 2020

Related U.S. Application Data

(63) Continuation of application No. 16/580,504, filed on Sep. 24, 2019, now Pat. No. 10,731,334, which is a continuation of application No. 15/977,462, filed on May 11, 2018, now Pat. No. 10,472,820.

(60) Provisional application No. 62/504,875, filed on May 11, 2017.

(51) Int. Cl.

| | |
|---|---|
| ***E04B 1/70*** | (2006.01) |
| ***E04B 1/76*** | (2006.01) |
| ***E04F 13/08*** | (2006.01) |
| ***E04B 1/74*** | (2006.01) |
| ***E04F 13/00*** | (2006.01) |

(52) U.S. Cl.

CPC ..... *E04B 1/7038* (2013.01); *E04B 1/7645* (2013.01); *E04F 13/0875* (2013.01); *E04F 13/0896* (2013.01); *E04B 2001/742* (2013.01); *E04F 13/007* (2013.01)

(58) Field of Classification Search

CPC ..... E04B 1/7038; E04B 2/707; E04B 1/762; E04B 1/7069; E04B 1/7645; E04F 13/047; E04F 13/0875; E04F 13/007

See application file for complete search history.

(56) References Cited

U.S. PATENT DOCUMENTS

| | | | | |
|---|---|---|---|---|
| 5,027,572 | A | 7/1991 | Purcell et al. | |
| 5,363,621 | A | 11/1994 | Kroll et al. | |
| 5,410,852 | A | 5/1995 | Edgar et al. | |
| 5,979,131 | A | 11/1999 | Remmele et al. | |
| 7,713,615 | B2 * | 5/2010 | Black | E04F 13/148 428/294.7 |
| 8,001,736 | B2 | 8/2011 | Goldberg et al. | |

(Continued)

*Primary Examiner* — Gisele D Ford

(74) *Attorney, Agent, or Firm* — Calfee, Halter & Griswold LLP

(57) ABSTRACT

Some embodiments include an exterior insulated finish wall assembly including an exterior panel member, an insert member, and a drainage channel. The exterior panel member includes a rigid insulative substrate and a base coat selectively disposed on the rigid insulative substrate. The rigid insulative substrate includes a body portion and a tail portion extending from the body portion. A recess is defined by a sloped surface and a back surface of the tail portion. The insert member is configured to be disposed within the recess. The insert member is sized and shaped to correspond to the recess. The insert member includes a rigid insulative substrate and a base coat selectively disposed on the rigid insulative substrate. The drainage channel is defined between the tail portion and the insert member.

20 Claims, 5 Drawing Sheets

(56) References Cited

U.S. PATENT DOCUMENTS

| | | | |
|---|---|---|---|
| 8,316,597 | B2 | 11/2012 | Goldberg et al. |
| 8,919,062 | B1 | 12/2014 | Viness et al. |
| 2006/0185299 | A1 | 8/2006 | Poupart |
| 2006/0225836 | A1 | 10/2006 | LeFevre et al. |
| 2006/0277854 | A1 | 12/2006 | Egan |
| 2007/0011986 | A1 | 1/2007 | Serino et al. |
| 2011/0036539 | A1 | 2/2011 | Balduini et al. |
| 2011/0078971 | A1 | 4/2011 | Adams |
| 2011/0265416 | A1 | 11/2011 | Southwell |
| 2013/0309454 | A1 | 11/2013 | Propst |
| 2015/0047281 | A1 | 2/2015 | Cole et al. |
| 2017/0306631 | A1 | 10/2017 | Kirk |
| 2018/0328026 | A1 | 11/2018 | Lutz |
| 2020/0018062 | A1 | 1/2020 | Lutz |

* cited by examiner

EXTERIOR INSULATED FINISH WALL ASSEMBLY

CROSS-REFERENCE TO RELATED APPLICATIONS

This application is a Continuation of U.S. patent application Ser. No. 16/580,504, filed Sep. 24, 2019, which is a Continuation of U.S. patent application Ser. No. 15/977,462 filed on May 11, 2018, entitled "Exterior Insulated Finish Wall Assembly" (as amended), now U.S. Pat. No. 10,472,820 issued Nov. 12, 2019, which claims priority under 35 U.S.C. § 119(e)(1) to U.S. Provisional Patent Application Ser. No. 62/504,875, filed May 11, 2017, entitled "Exterior Insulation and Finish Wall Drainage System", the entire teachings of which are incorporated herein by reference.

BACKGROUND

Improvements in building construction have resulted in wall assemblies that are highly energy efficient. These wall assemblies are often highly insulated and include sealed joints around windows and doors to prevent drafts. While these walls have high thermal efficiency, it has been observed that moisture can potentially accumulate inside the wall over time due to naturally occurring temperature and/or humidity gradients. In addition, moisture can potentially accumulate inside sealed walls due to water running down a steeply pitched roof, for example in the case where the joint/seal between the wall and the roof deteriorates and provides an ingress location for water into the wall.

Moisture trapped inside of the walls includes moisture vapor and bulk water, such as condensation. Condensation can form inside a wall due to temperature differences across the insulated walls. For example, during typical northern cold winter months, the air outside of an insulated wall is cold and dry, and the air inside of the wall is relatively warm and humid. Thus, a natural humidity gradient is formed that drives moisture vapor in the air inside the wall toward the exterior of the wall. Large gradients between outside and inside air temperature and humidity can lead to a significant accumulation of moisture condensation within the insulated wall. Exterior wall systems can employ drainage features, such as weep holes, for example, that can be aesthetically unacceptable. Often exterior insulation and finish systems (EIFS) do not include drainage features, and particularly, do not include aesthetically acceptable drainage features to divert water from a drainage plane of an exterior wall system.

DETAILED DESCRIPTION

In the following Detailed Description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

As used herein, moisture includes bulk liquid water, such as rain or rain droplets, and moisture vapor, such as humidity contained in the air.

As used herein, fluid is a broad term that includes both gases and liquids.

As used herein, barrier means to substantially prevent or deny the through-passage of air and to substantially prevent or deny the passage of moisture vapor. Thus, barrier as used herein means to substantially prevent the through-passage of moisture through the barrier, whether the moisture is in the form of moisture vapor or bulk liquid.

As defined herein, building envelope assembly is a broad term which includes any assemblies which separate interior and exterior environments of a building. A building envelope assembly serves to protect the indoor environment from the elements of nature (e.g., rain, snow, etc.) and facilitate its climate control. A building envelope assembly as defined herein includes vertical assemblies, such as walls, and non-vertical assemblies, for example.

Figure 1:
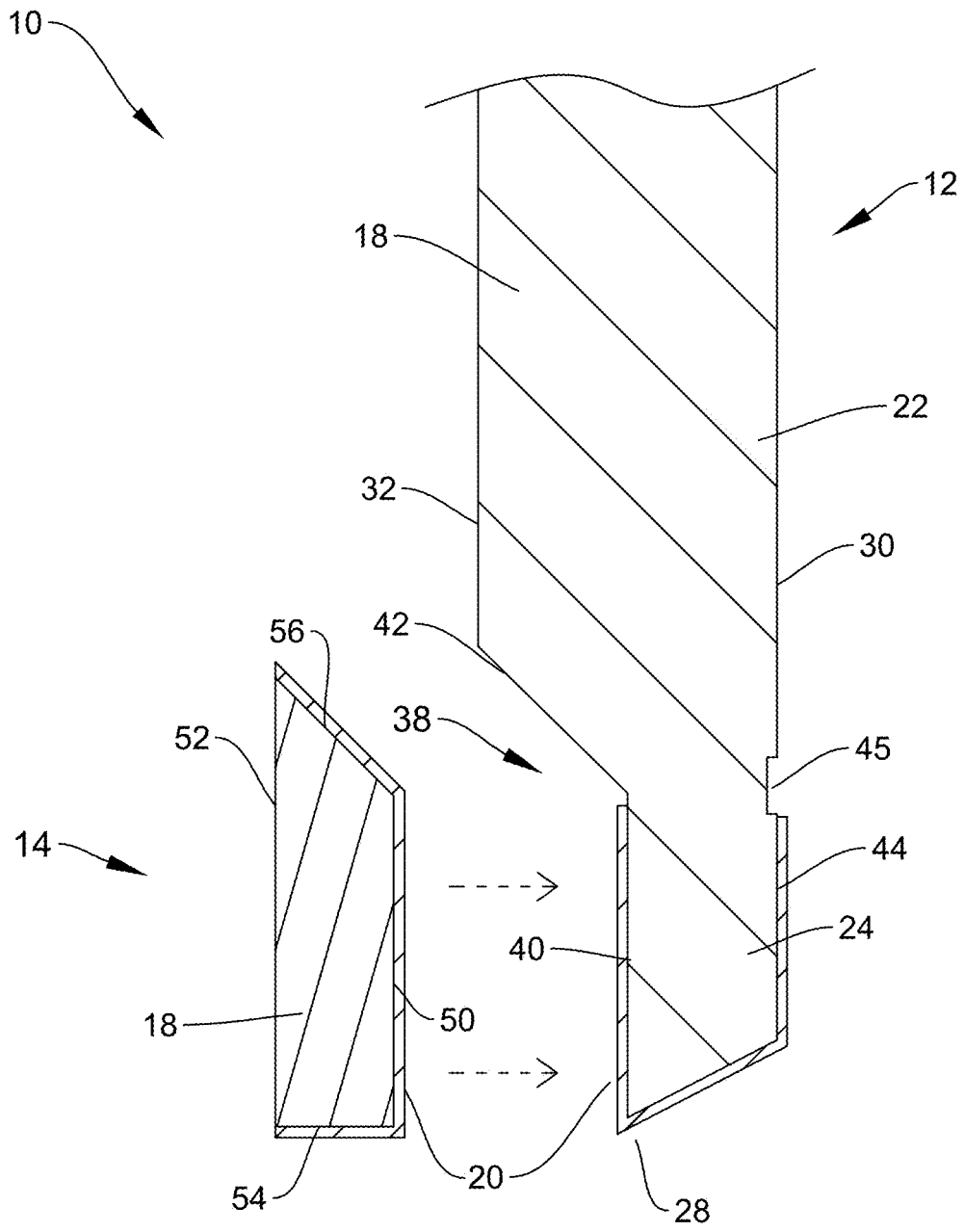
FIG. 1 is a partial exploded cross-sectional view of an exterior insulated finish wall assembly in accordance with aspects of the present disclosure.

FIG. 1 illustrates a partial exploded cross-sectional view of an exterior insulated finish wall assembly 10 in accordance with one embodiment of the present disclosure. The exterior insulated finish wall assembly 10 can be included in an exterior insulation and finish system (EIFS) wall 100 (see e.g., FIG. 4) and as part of a building envelope assembly. In general, exterior insulated finish wall assembly 10 includes an exterior panel member 12 and an insert member 14. When assembled, the exterior panel member 12 and the insert member 14 can define a drainage channel 16 therebetween (see e.g., FIG. 4). The exterior panel and insert members 12, 14 can each include a substrate layer 18 and a base coat 20, as described further below.

The rigid insulative substrate 18 can be formed of rigid foam insulation, such as expanded polystyrene (EPS) or extruded polystyrene (XPS), for example. Other suitable types of rigid insulation or substrates are also acceptable. The rigid insulative substrate 18 is a suitable thickness and material to provide the desired insulative value (R-value) and comply with applicable building codes. The rigid insulative substrate 18 can have any suitable thickness. In one embodiment, the rigid insulative substrate 18 of the base member has a thickness of 2 inches and the insert member has a thickness of approximately 1 inch. The rigid insulative substrate 18 can also include recesses, cutouts, bevels, channels, grooves, etc. (e.g., for architectural or other purposes) that vary the thickness across select portions of the rigid insulative substrate 18, without changing the overall insulative value of the exterior wall insulation and finish assembly 10. The rigid insulative substrate 18 can include a single or multiple sections fit together to form a continuous layer. The rigid insulative substrate 18 can be formed into any appropriate shape including, but not limited to, planar, curved, or angled. The exterior surface of the rigid insulative substrate 18 can be scarified or rasped to provide a textured bonding surface for adherence of coatings or finishes.

As illustrated in FIG. 1, the base coat 20 can be selectively applied over the surfaces of the rigid insulative substrate 18 of the exterior panel member 12 and the insert member 14. The base coat 20 can be an acrylic cementious coating or an acrylic non-cementious coating, for example. The base coat 20 can be fiber-reinforced. Other coatings can also be acceptable. The base coat 20 can include adhesive properties to self-adhere to surfaces. Alternatively, or in addition, a mesh 21 can be applied to the rigid insulative substrate 18 to aid in bonding of the base coat 20 with the rigid insulative substrate 18. The mesh 21 can be embedded in the base coat 20 on the rigid insulative substrate 18. In one example, the mesh 21 is a fiberglass mesh, although other types of reinforcing mesh can also be suitable. The mesh 21 can be self-adhesive or adhered to the rigid insulative substrate 18 with an adhesive. The mesh 21 can extend past the termination of the base coat 20 or terminate with the base coat 20, as appropriate for proper adhesion between the base coat 20 and the rigid insulative substrate 18. The base coat 20 can be disposed on the rigid insulative layer 18 as suitable to provide applicable fire code ratings and/or to provide reinforcement to the rigid insulative layer 18.

Figure 2A:
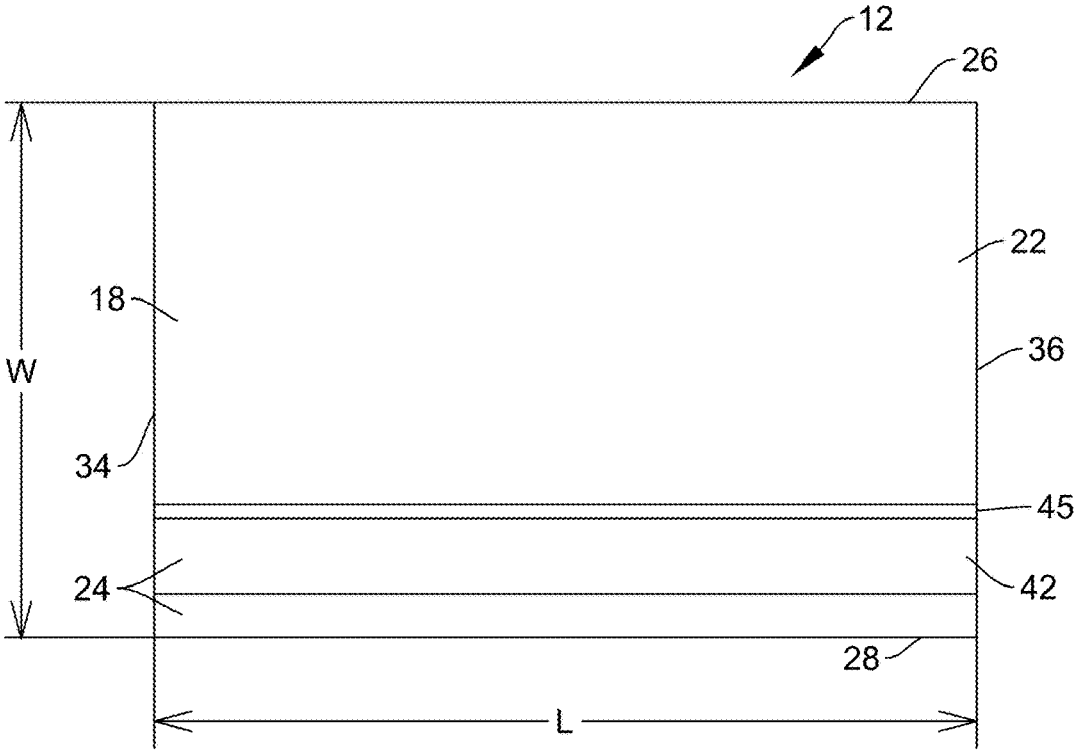
FIGS. 2A-2B are front and back views of an exterior wall member of the exterior insulated finish wall assembly in accordance with aspects of the present disclosure.
Figure 2B:
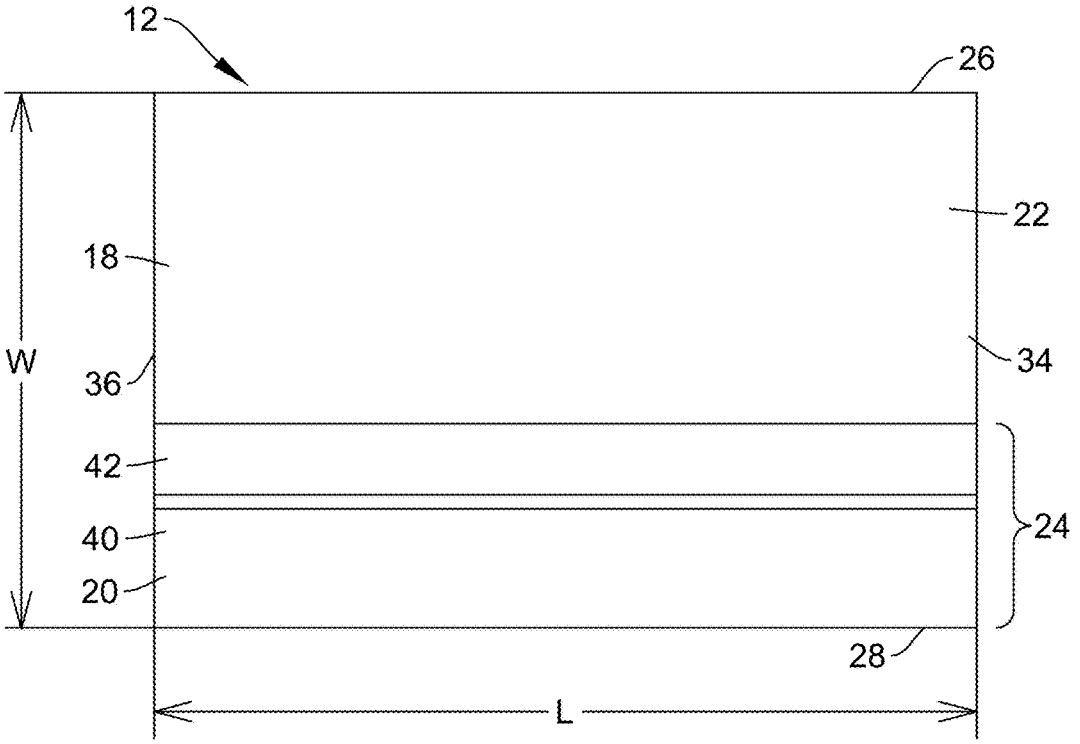

With additional reference to FIGS. 2A-2B, the exterior panel member 12 includes a body portion 22 and a tail portion 24 extending from the tail portion 24. The body portion 22 defines a top edge 26 of the exterior panel member 12 and the tail portion 24 defines a bottom edge 28 of the exterior panel member 12. The exterior panel member 12 has a first, or exterior, surface 30 and a second, or interior surface 32 extending between opposing side edges 34, 36 and having a first thickness. The first and second surfaces 30 can be generally planar. The tail portion 24 includes a recess 38 extending between the opposing side edges 34, 36. The tail portion 24 has a second thickness less than the first thickness. In one example, the second thickness of the tail portion 24 is approximately half of the first thickness of the body portion 22. In one embodiment, the tail portion 42 maintains a ¾" thickness. The recess 38 extends into the panel member 12 from the second surface 32 partially toward the first surface 30 at the tail portion 24. The recess 38 extends longitudinally along the bottom edge 28 and is defined by a recessed surface 40 and a sloped surface 42 extending from the second surface 32 to the recessed surface 40. The sloped surface 42 forms an obtuse angle with the second surface 32. In this manner, the sloped surface 42 is sloped downward from the second surface 32 toward the recessed surface 40. The recess 38 is shaped and sized to accommodate the insert member 14 and form the drainage channel 16 between the exterior wall member 12 and the insert member 14. The tail portion 24 of the exterior panel member 12 defines a recess 38 configured to accommodate the insert member 14 and the drainage channel 16 formed therebetween. In another embodiment, a first face 44 of the tail portion 24 is coplanar, or substantially coplanar, with the first surface 30 of the body portion 22. In one embodiment, the first face 44 of the tail portion 24 can be slightly recessed from the first surface 30 of the body portion 22. Although, illustrated as angled, or non-perpendicular, the bottom edge 28 of the tail portion 24 can be squared, rounded, angled, or other desired shape.

The exterior wall member 12 can include the base coat 20 disposed on, and encapsulates, the bottom edge 28, the recessed surface 40, and the first face 44 of the tail portion. In one embodiment, the base coat 20 extends approximately 2½" from the bottom edge 28 along the recessed surface 40 and the first face 44. Other suitable distances of coverage can also be acceptable. A groove 45 can be included in the rigid insulative layer 18 along the first surface 30, above a top terminating edge of the base coat 20, to provide a transition of the body portion 22 to facilitate rasping of the insulation to prepare for additional finishes, for example. The first surface 30 of the body portion 22 can be generally planar to an exterior surface of the base coat 20 on the tail portion 24.

Figure 3A:
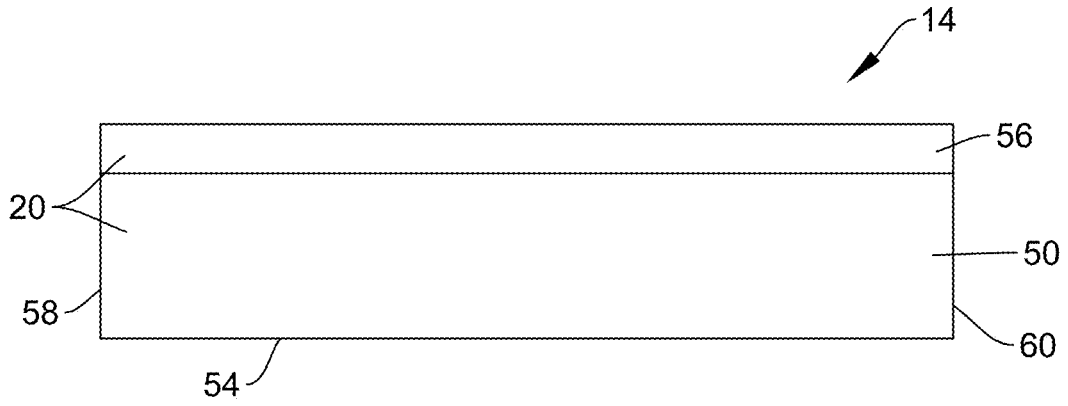
FIGS. 3A-3B are front and back views of an insert member of the exterior insulated finish wall assembly in accordance with aspects of the present disclosure.
Figure 3B:
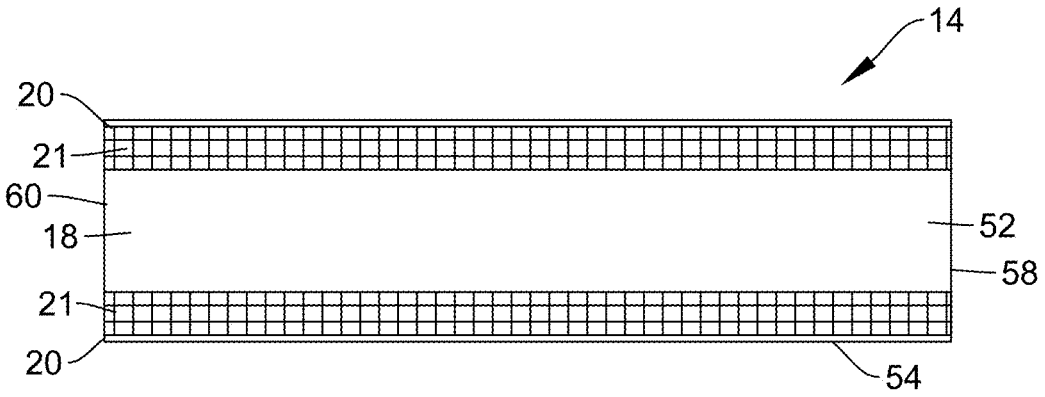

With continued reference to FIG. 1 and additional reference to FIGS. 3A-3B, the insert member 14 includes a front face 50, a back face 52, a bottom face 54, and a top face 56. The insert member 14 extends between opposing sides 58, 60 and can have a length equivalent to a length of the exterior panel member 12. The top face 56 is shaped and sized to correspond with the sloped surface 42 of recess 38 formed at the tail portion 24. The top face 50 can be orientated at a 45 degree angle, or other suitable angle, to be sloped from the back face 52 to the front face 50, for example. The top face 56 can be formed at any appropriate angle to facilitate moisture/water to flow by gravity from interior side of the exterior wall insulation finish assembly 10 toward an exterior. The front face 50 extends parallel to the recessed surface 40 of the tail portion 24. The back face 52 can be parallel to the front face 50. The base coat 20 can be disposed on, and encapsulate, the bottom face 54, the front face 50, and the top face 56.

Figure 4:
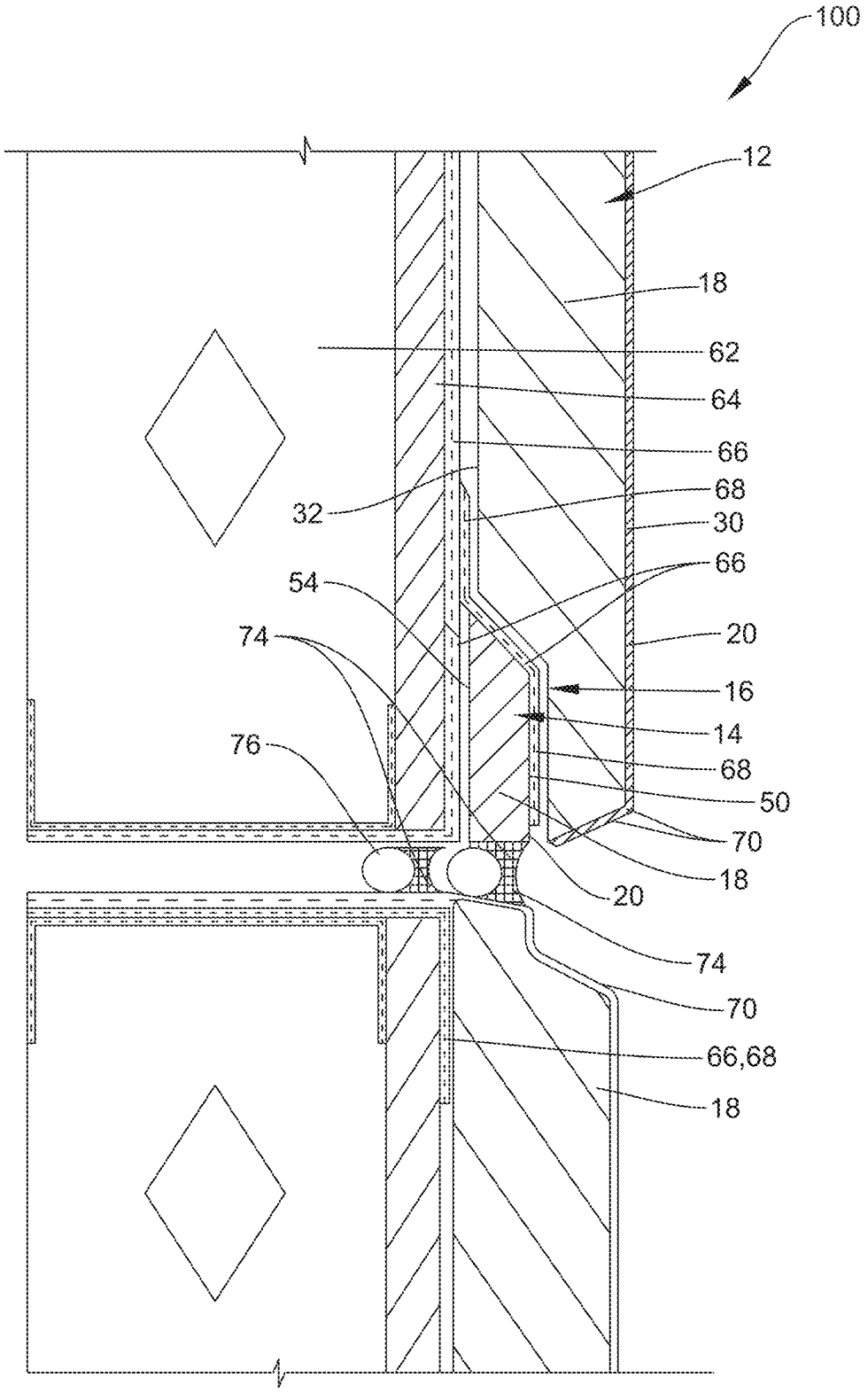
FIG. 4 is a partial cross-sectional view of an exterior insulated finish wall system in accordance with aspects of the present disclosure.
Figure 5:
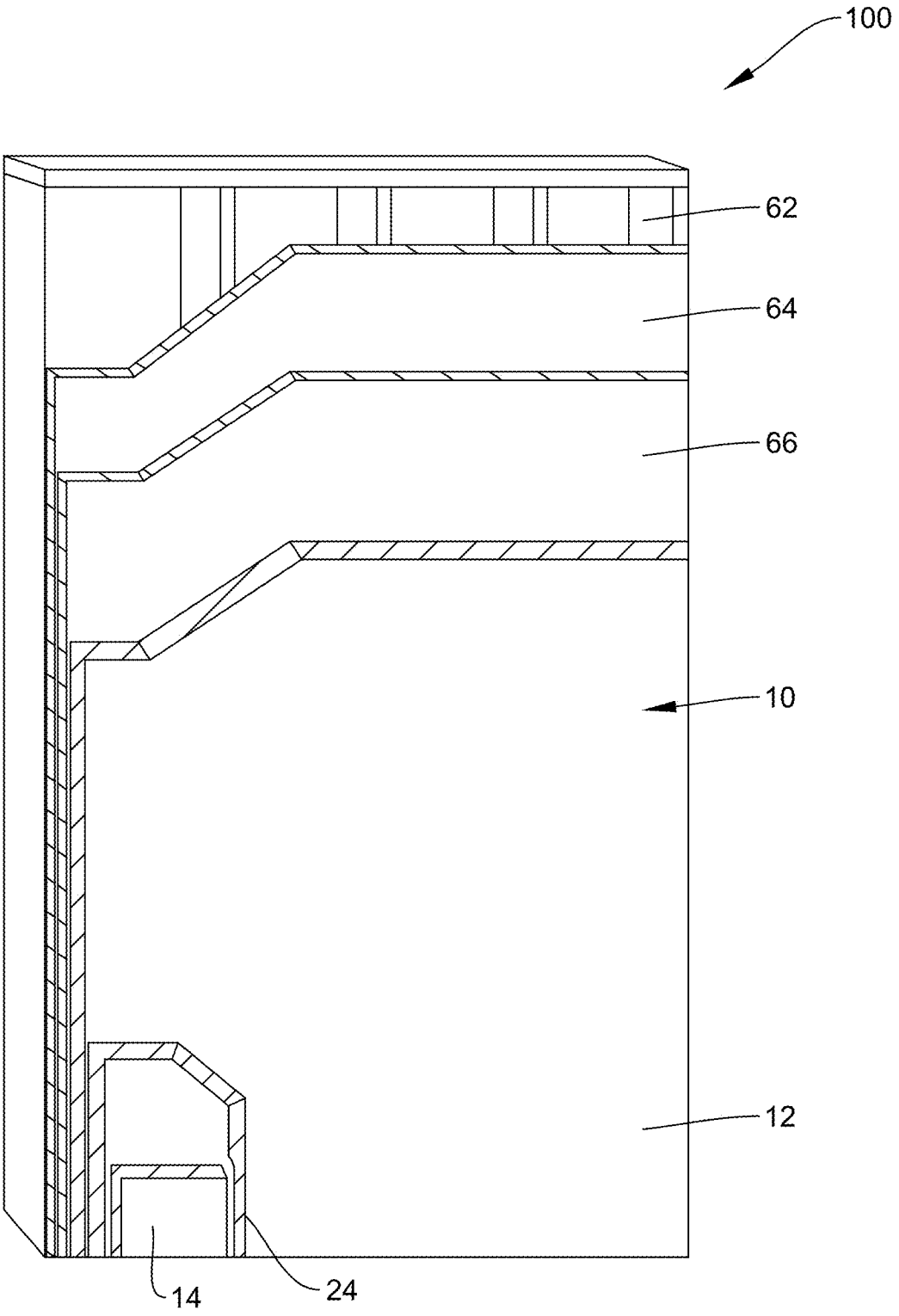
FIG. 5 is a schematic representation of various layers of an exterior wall panel system in accordance with aspects of the present disclosure.

With additional reference to FIGS. 4 and 5, the exterior wall insulation finish assembly 10 can be assembled to form an exterior wall panel system 100. The exterior wall panel system 100 can include framing 62, a substrate layer 64, and moisture barrier 66. The framing 62 can be metal stud framing spaced at 16 inches on-center, or other appropriate spacing, for example. Insulation, such as unfaced fiberglass batt insulation, can be disposed between framing members to provide additional insulative value, if desired (not shown). Alternatively, framing 62 can be concrete, masonry, or other rigid material. The substrate layer, or sheathing, 64 can be gypsum sheathing, exposed oriented strand board (OSB), exterior or exposure 1 grade plywood, or a masonry substrate such as cement masonry unit blocks or bricks, for example. The sheathing 64 can extend across a length and width of the framing 62, for example, to provide a surface to which other layers can be disposed and/or attached. The sheathing 64 can be adhered or mechanically attached to the framing 62.

The moisture barrier 66 can be disposed across the outer surface of the sheathing 64. The moisture barrier 66 can be a membrane formed of latex-based coating serving to resist moisture and air penetration. The moisture barrier 66 can be fluid applied or applied as a sheet building wrap. A flashing membrane 68 that is resistive to fluid (e.g., air and water) can be selectively applied to the substrate 64. In some embodiments, the moisture barrier 66 and the flashing membrane are formed of the same material. The flashing membrane 68 is a fluid resistive membrane barrier over the sheathing 64 and to bridge across sheathing joints at openings, such as horizontal joints. The flashing membrane 68 can be a liquid applied membrane or a sheet membrane. The flashing membrane 68 can be a flexible, water-based polymer material applied over a mesh, or non-woven blend fabric. In one example, Dryvit AquaFlash® is used. The flashing membrane 68 can be applied along a lower portion of the sheathing 64 and along a bottom surface of the framing 62 and the sheathing 64 within a joint space.

The insert member 14 of the exterior wall insulation finish assembly can be attached to the sheathing 64 over the flashing membrane 68 with adhesive 58 or other means. The flashing membrane 68 can then be applied over the top face 56 and front face 50 of the insert member 14 and extending above the top face 50 onto the moisture barrier 66 and/or sheathing 64 to prevent moisture from between the insert member 14 and the sheathing 64 and provide drainage along the front face 50.

Adhesive is applied to adhere the exterior wall member 12 to the sheathing 64 and/or moisture barrier 66. The adhesive can be applied with a notched trowel in a manner that provides vertical grooves formed by the notches, within the adhesive. When assembled, the bottom edge 28 of the exterior wall member 12 can extend generally planar to the bottom face 54 of the tail portion 14. The bottom edge 28 can be substantially aligned with the bottom face 54. The drainage channel 16 can be formed between or within the exterior panel member and insert members 14, 16 with the flashing membrane 68 extending therethrough.

The interior or, second and back surfaces 32, 52, of the exterior wall member 12 and insert member 14 extend along a first plane when assembled. The flashing membrane 68 can channel, or direct, moisture from an interior surface of the rigid insulative layer 18 along the top face 56 and front face 50 with the aid of gravity without moisture penetrating either the insert member 14 or the exterior wall member 12. Sealant 74 and backer rod 76 can be included at horizontal and vertical joints between panels 100, etc. The sealant 74 is disposed behind, or interior to, the front face 50 of the insert member 14 to allow drainage from between the insert member 14 and the exterior wall member 12 to exterior of the wall system 100.

A finish coating 70 can be included over the exterior wall member 12. The finish coating 70 can include adhesive properties to self-adhere to surfaces. The finish coating 70 can include one or more layers that can be troweled on or spray applied. At least one of the coating layers can be an acrylic copolymer coating, such as Dryvit's Dirt Pickup Resistance (DPR) finishes, for example. Other or additional exterior coatings can also be acceptable.

In accordance with aspects of the present disclosure, the wall system 100 can be prefabricated wall panels fabricated in a controlled manufacturing facility and delivered to a building project site or can be assembled at a building project site. During fabrication, the rigid insulative layer 18 of the exterior wall member 12 and the insert member 14 can be formed from a standard sheet of rigid insulation material and cut to the desired size and shape using computer numerical controlled (CNC) machining. The mesh 21 can adhered to the formed rigid insulative layer 18. For example, a 3½" or 4" wide self-adhesive fiberglass mesh can be applied to the rigid insulative layer 18. The base coat 20 can be a liquid coating applied using a mud box including a template corresponding to the surfaces of the formed rigid insulative layer 18 to which the base coat 20 is to be applied and feeding the mesh 21 applied exterior wall member 12 and insert member 14 through the mud box either mechanically or manually. Alternatively, the base coat 20 can be applied by machine, spraying, or hand troweling. The mesh 21 and base coat are cured onto the rigid insulative layer 18.

The framing 62 can include a base plate, a top plate, and vertical stud members extending between the base plate and the top plate. The sheathing layer 64 can be attached to the framing 62. Alternatively or additionally, a hat channel can be disposed along a surface of the sheathing 64. The sheathing 64 can be formed of standard sheets of rigid insulation assembled and abutting edge to edge and/or as desired to form the desired sheathing layer and attached to the framing 62 with adhesive, for example. The moisture barrier 66 and flashing membrane 68 can be disposed over the insert member 14, sheathing 64 and framing 62 to form an edge wrap along terminating edges of the panel assemblies. Edges of the wall panel body can include edge wraps disposed on all or some perimeter edges of the wall panel body.

The assembled exterior wall panels 100 can be any desired shape. For example, the assembled wall panels 100 can include sections that are angled relative to one another. Grooves or other desired surface features can be included for aesthetic or other purposes. In other examples, openings can be included for windows, doors, electrical and mechanical equipment, etc. The wall panels 100 can be ready for installation and loaded for delivery to a jobsite for installation on a building structure. The wall panels 100 can be attached to a floor slab or other structural member of a building structure with embedded angle, clips, or other mechanical methods.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. An exterior insulated finish wall assembly comprising:

an exterior panel member comprising a rigid insulative substrate, the rigid insulative substrate comprising a body portion and a tail portion extending from the body portion, wherein a recess is defined by a sloped surface and a back surface of the tail portion;

an insert member configured to be disposed within the recess, the insert member is sized and shaped to correspond to the recess, the insert member comprising the rigid insulative substrate; and a drainage channel defined between the sloped and back surfaces of the tail portion and the insert member.

2. The assembly of claim 1, wherein the drainage channel extends to a bottom side of the insert member.

3. The assembly of claim 1, wherein the sloped surface extends from a back surface of the body portion to the back surface of the tail portion.

4. The assembly of claim 1, wherein a width of the body portion is substantially equal to a combined width of the tail portion and the insert member.

5. The assembly of claim 1, wherein a bottom surface of the insert member is substantially aligned with a bottom edge of the tail portion when assembled.

6. The assembly of claim 1, wherein the back surface of the tail portion is parallel to and offset from a back surface of the body portion.

7. The assembly of claim 1, further comprising a flashing disposed within the drainage channel between the exterior wall panel and the insert member.

8. The assembly of claim 1, wherein a front face of the insert member is disposed along the back surface of the tail portion.

9. The assembly of claim 1, further comprising a base coat disposed on a front face, a back face, and a top face of the insert member.

10. An exterior wall panel system comprising:

a frame;

a substrate layer disposed along an exterior side of the frame; and an exterior insulated finish wall assembly disposed along an exterior side of the substrate layer, the exterior insulated finish wall assembly comprising:

an exterior wall panel comprising a rigid insulative substrate and having a body portion and a tail portion, the exterior wall panel having a front surface, a back surface, and a recessed surface;

an insert member comprising the rigid insulative substrate, wherein the insert member is disposed along the recessed surface between the tail portion of the exterior wall panel and the substrate layer;

a drainage channel defined between the exterior wall panel and the insert member;

and a flashing disposed within the drainage channel between the exterior wall panel and the insert member.

11. The system of claim 10, further comprising a base coat selectively applied to the rigid insulative substrate of the tail portion and the insert member.

12. The system of claim 11, wherein the base coat comprises a reinforcing mesh.

13. The system of claim 11, wherein the base coat is selectively disposed on the exterior wall panel and the insert member along the drainage channel.

14. The system of claim 11, further comprising a second coating disposed along the front surface.

15. The system of claim 10, further comprising a sealant disposed along a bottom of the insert member, wherein the drainage channel terminates exterior of the sealant.

16. The system of claim 10, wherein the drainage channel is configured to direct moisture to an exterior of the exterior insulated finish wall assembly.

17. An exterior wall panel system comprising:

a frame;

a substrate layer disposed along an exterior side of the frame; and an exterior insulated finish wall assembly disposed along an exterior side of the substrate layer, the exterior insulated finish wall assembly comprising:

an exterior panel member comprising a rigid insulative substrate that comprises a body portion and a tail portion extending from the body portion, and a base coat selectively disposed on the rigid insulative substrate, the rigid insulative substrate having a front surface, an opposing back surface, and a recess defined by a sloped surface and a back surface of the tail portion, and an insert member configured to be disposed within the recess, wherein a front surface of the insert member is offset from the front surface of the rigid insulative substrate of the exterior panel member when disposed within the recess;

wherein a drainage channel is defined between the sloped and back surfaces of the tail portion and the insert member.

18. The system of claim 17, wherein a thickness of the insert member is substantially equal to a thickness of the tail portion.

19. The system of claim 17, wherein the drainage channel extends to a bottom of the insert member.

20. The system of claim 17, wherein the drainage channel is configured to direct moisture to an exterior of the exterior insulated finish wall assembly.

* * * * *